US009539810B2

(12) United States Patent
Tamura et al.

(10) Patent No.: US 9,539,810 B2
(45) Date of Patent: Jan. 10, 2017

(54) LIQUID DISCHARGE HEAD AND HEAD UNIT USING THE SAME

(71) Applicant: CANON KABUSHIKI KAISHA, Tokyo (JP)

(72) Inventors: Yasuyuki Tamura, Yokohama (JP); Toru Nakakubo, Kawasaki (JP); Yohei Nakamura, Hiratsuka (JP); Naoto Sasagawa, Kawasaki (JP); Toshio Suzuki, Sagamihara (JP); Yasuto Kodera, Fujisawa (JP); Ryota Kashu, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/821,116

(22) Filed: Aug. 7, 2015

(65) Prior Publication Data

US 2016/0059555 A1 Mar. 3, 2016

(30) Foreign Application Priority Data

Aug. 29, 2014 (JP) ..... 2014-175523

(51) Int. Cl.
*B41J 2/14* (2006.01)

(52) U.S. Cl.
CPC ..... *B41J 2/14201* (2013.01); *B41J 2/14233* (2013.01); *B41J 2002/14419* (2013.01);
(Continued)

(58) Field of Classification Search
CPC ..... B41J 2/18; B41J 2/19; B41J 2002/1853
See application file for complete search history.

(56) References Cited

U.S. PATENT DOCUMENTS 8,517,518 B2 8/2013 Kashu et al.
8,636,349 B2 1/2014 Nakakubo et al.
(Continued)

FOREIGN PATENT DOCUMENTS

CN 102218915 A 10/2011
CN 102481789 A 5/2012
(Continued)

OTHER PUBLICATIONS

Extended European Search Report dated May 25, 2016, in European Patent Application No. 15002421.4.
(Continued)

*Primary Examiner* — Geoffrey Mruk
(74) *Attorney, Agent, or Firm* — Fitzpatrick, Cella, Harper & Scinto

(57) ABSTRACT

A liquid discharge head including plural liquid discharge portions each including a discharge port for discharging liquid, plural discharge ports forming a discharge port array; a common liquid supply flow path extending adjacent to the discharge port array on one side of the discharge port array; and a common liquid collection flow path extending adjacent to the discharge port array on the other side of the discharge port array. Each liquid discharge portion includes a pressure chamber having the discharge port, and a piezoelectric element facing the discharge port. The pressure chamber includes an inlet and an outlet end portion respectively connected to the common liquid supply and collection flow paths, and has an elongated shape connecting the inlet and outlet end portions. A plurality of inlet and outlet end portions are respectively arranged along the common liquid supply flow path and the common liquid collection flow path.

19 Claims, 7 Drawing Sheets

(52) U.S. Cl.
CPC ..... *B41J 2002/14459* (2013.01); *B41J 2002/14491* (2013.01); *B41J 2202/11* (2013.01); *B41J 2202/12* (2013.01)

(56) References Cited

U.S. PATENT DOCUMENTS

| | | | | |
|---|---|---|---|---|
| 8,740,365 | B2 | 6/2014 | Uezawa et al. | |
| 8,807,713 | B2 | 8/2014 | Nakamura et al. | |
| 8,820,895 | B2 | 9/2014 | Bibl et al. | |
| 8,851,639 | B2 | 10/2014 | Arimoto | |
| 8,857,953 | B2 | 10/2014 | Suzuki et al. | |
| 8,919,931 | B2 | 12/2014 | Yokota | |
| 8,967,773 | B2 | 3/2015 | Suzuki et al. | |
| 8,985,748 | B2 | 3/2015 | Nakakubo | |
| 9,278,368 | B2 | 3/2016 | Bibl et al. | |
| 2008/0238980 | A1 | 10/2008 | Nagashima et al. | |
| 2010/0225706 | A1 | 9/2010 | Yamamoto | |
| 2011/0007117 | A1 | 1/2011 | Bibl et al. | |
| 2012/0256989 | A1* | 10/2012 | Uezawa ..... | B41J 2/14233 347/54 |
| 2013/0076836 | A1 | 3/2013 | Yokota | |
| 2013/0208059 | A1* | 8/2013 | Arimoto ..... | B41J 2/175 347/85 |
| 2013/0286096 | A1 | 10/2013 | Kodoi et al. | |
| 2014/0191062 | A1 | 7/2014 | Sasagawa et al. | |
| 2014/0239089 | A1 | 8/2014 | Bibl et al. | |
| 2016/0185114 | A1 | 6/2016 | Bibl et al. | |

FOREIGN PATENT DOCUMENTS

| | | | |
|---|---|---|---|
| CN | 103009807 | A | 4/2013 |
| CN | 103241003 | A | 8/2013 |
| EP | 1 380 421 | A1 | 1/2004 |
| JP | 2012-006224 | A | 1/2012 |
| JP | 2012-532772 | A | 12/2012 |
| WO | 01/08888 | A1 | 2/2001 |
| WO | 2009/143025 | A1 | 11/2009 |

OTHER PUBLICATIONS

Office Action dated Jul. 21, 2016 in Chinese Application No. 201510527749.6.

U.S. Appl. No. 14/821,093, filed Aug. 7, 2015, Yasuyuki Tamura, Masato Yajima, Yasuto Kodera, Naoto Sasagawa.

* cited by examiner

LIQUID DISCHARGE HEAD AND HEAD UNIT USING THE SAME

BACKGROUND OF THE INVENTION

Field of the Invention

The present invention relates to a liquid discharge head and a head unit using the same, and particularly, to a liquid discharge head that drives a piezoelectric element to discharge a liquid.

Description of the Related Art

Liquid discharge apparatuses that discharge a liquid, such as ink, onto a recording object to perform recording include a liquid discharge head in which a number of liquid discharge portions are arranged in two dimensions in order to perform higher-definition recording at high speed. Each liquid discharge portion has a pressure chamber including a discharge port, and pressure generating means that is provided to face the pressure chamber. It is also known that a piezoelectric element is used as the pressure generating means. Particularly, it is relatively easy to densely and precisely arrange bending-type piezoelectric elements in which the wall surface of a pressure chamber facing a discharge port is bent and deformed by a piezoelectric element and that increase and decrease the volume of the pressure chamber, and thus, the bending-type piezoelectric elements are widely used. In the liquid discharge portion of the liquid discharge head, there is a period of time for which a liquid is not discharged during operation. Even when recording is continuously performed, according to a drawing pattern to be printed, such as a blank, space, or the like of a recording object, there is a discharge port that does not discharge a liquid for a long time. During the time period in which the liquid is not discharged, the liquid in the vicinity of the discharge port may deteriorate due to evaporation, and consequently a discharge failure may occur. Therefore, in order not to use excessive time to restore the discharge port where the discharge failure has occurred, it is desired to prevent the discharge failure resulting from the evaporation or the like of the liquid.

A liquid discharge head in which an inlet end portion and an outlet end portion are provided in a pressure chamber of a liquid discharge portion is disclosed in Japanese Patent Application Laid-Open No. 2012-532772. A portion of the liquid that has flowed in from the inlet end portion is discharged from the discharge port by the operation of a bending-type piezoelectric element, and the remaining liquid is discharged from the outlet end portion. When a liquid is not discharged, the entire quantity of the liquid that has flowed in from the inlet end portion is discharged from the outlet end portion. Accordingly, the flowing of a liquid is always maintained within the pressure chamber to realize a so-called through-flow, irrespective of whether the liquid is discharged from the discharge port. Since the liquid does not easily stagnate in the vicinity of the discharge port, a discharge failure caused by the deterioration of the liquid does not occur easily. A liquid discharge head including two inlet end portions in one pressure chamber is disclosed in Japanese Patent Application Laid-Open No. 2012-006224.

In the liquid discharge head described in Japanese Patent Application Laid-Open No. 2012-532772, a plurality of the liquid discharge portions is connected to a common liquid supply flow path and a common liquid collection flow path. Therefore, the common liquid supply flow path and the common liquid collection flow path need to allow a total flow rate of liquid required for the plurality of liquid discharge portions connected thereto to flow therethrough.

However, in the liquid discharge head in which the liquid discharge portions are arranged in high density, the flow path cross-sectional areas of the common liquid supply flow path and the common liquid collection flow path are liable to be limited. Particularly, in the liquid discharge head described in Japanese Patent Application Laid-Open No. 2012-532772, the shape of the pressure chamber is circular. Therefore, it is difficult to reduce the intervals of the pressure chambers adjacent to each other, and it is difficult to shorten the lengths of the common liquid supply flow path and the common liquid collection flow path. For this reason, the pressure gradient or pressure loss along the common liquid supply flow path and the common liquid collection flow path are liable to occur, and it is difficult to control the negative pressure of a liquid such that a uniform meniscus is formed in all of the discharge ports. Moreover, since the discharge port is located at the center of the circular pressure chamber, a flow velocity at the position of the discharge port is smaller than that at the other positions of the pressure chamber, and it is necessary to increase a flow rate in order to obtain the effects of the through-flow. However, if the flow rate is increased, the pressure loss resulting from the flow path resistances of the common liquid supply flow path and the common liquid collection flow path are further increased.

In order to solve this problem, as described in Japanese Patent Application Laid-Open No. 2012-006224, it is also considered that two common liquid supply flow paths are provided, and the flow rate of each common liquid supply flow path is suppressed. However, the supply of a liquid in Japanese Patent Application Laid-Open No. 2012-006224 does not relate to the through-flow. If the liquid discharge head in Japanese Patent Application Laid-Open No. 2012-006224 is used in order to realize the through-flow, it is necessary to separately provide a common liquid collection flow path. Therefore, the liquid discharge portions are not able to be arranged in high density.

SUMMARY OF THE INVENTION

According to an aspect of the present invention, there is provided a liquid discharge head including: a plurality of liquid discharge portions each including a discharge port for discharging a liquid, a plurality of discharge ports forming a discharge port array; a common liquid supply flow path extending adjacent to the discharge port array on one side of the discharge port array; and a common liquid collection flow path extending adjacent to the discharge port array on the other side of the discharge port array. Each of the plurality of liquid discharge portions includes a pressure chamber having the discharge port, and a piezoelectric element facing the discharge port. The pressure chamber includes an inlet end portion connected to the common liquid supply flow path and an outlet end portion connected to the common liquid collection flow path, and has an elongated shape connecting the inlet end portion and the outlet end portion. A plurality of inlet end portions are arranged along the common liquid supply flow path, and a plurality of outlet end portions are arranged along the common liquid collection flow path.

Each of the plurality of pressure chambers has an elongated shape connecting the inlet end portion and the outlet end portion, the plurality of inlet end portions are arranged along the common liquid supply flow path, and the plurality of outlet end portions are arranged along the common liquid collection flow path. Therefore, the plurality of pressure chambers are able to be arranged in high density along the common liquid supply flow path and the common liquid collection flow path. Accordingly, the lengths of the common liquid supply flow path and the common liquid collection flow path are able to be shortened, and the pressure loss in the common liquid supply flow path and the common liquid collection flow path is able to be reduced.

Further features of the present invention will become apparent from the following description of exemplary embodiments with reference to the attached drawings.

DESCRIPTION OF THE EMBODIMENTS

Preferred embodiments of the present invention will now be described in detail in accordance with the accompanying drawings.

A liquid discharge head of the present invention is able to be applied to a liquid discharge apparatus that forms a beautiful image on a recording object at high speed with high definition. An example of the liquid discharge apparatus includes an ink jet printer. The liquid discharge head of the present invention is able to be broadly applied to industrial applications, such as production apparatuses that form a pattern on a resin substrate or the like with a conductive liquid, to form a wiring pattern.

First Embodiment

Figure 1:
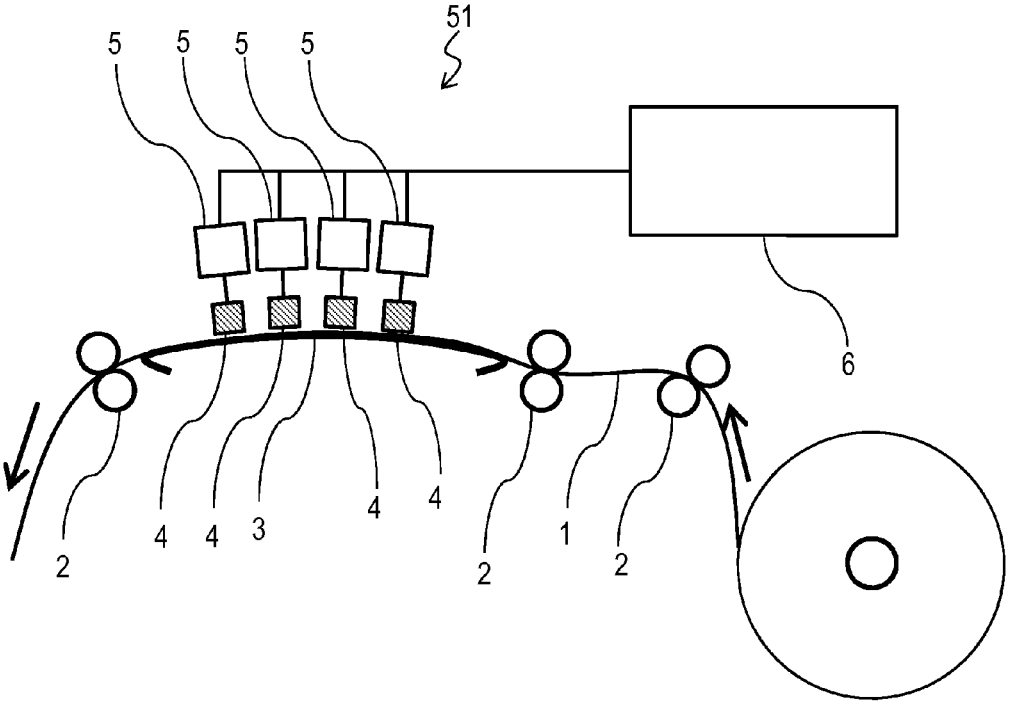
FIG. 1 is a schematic configuration diagram of a liquid discharge apparatus of the present invention.

A schematic configuration of a liquid discharge apparatus 51 of the present embodiment is illustrated in FIG. 1. Recording paper 1 that is a recording object is fed in the arrow direction by a paper feed roller 2 that conveys the recording object, and recording is performed on a platen 3. The liquid discharge apparatus 51 has four sets of head units 4 that discharge liquids (for example, ink) in colors of cyan, magenta, yellow, and black, respectively. A driving unit 5 that electrically drives a piezoelectric element 10 of a liquid discharge head 7 is connected to each head unit 4. The driving unit 5 generates a driving signal for the piezoelectric element 10 on the basis of an image signal sent from a controller 6.

Figure 2:
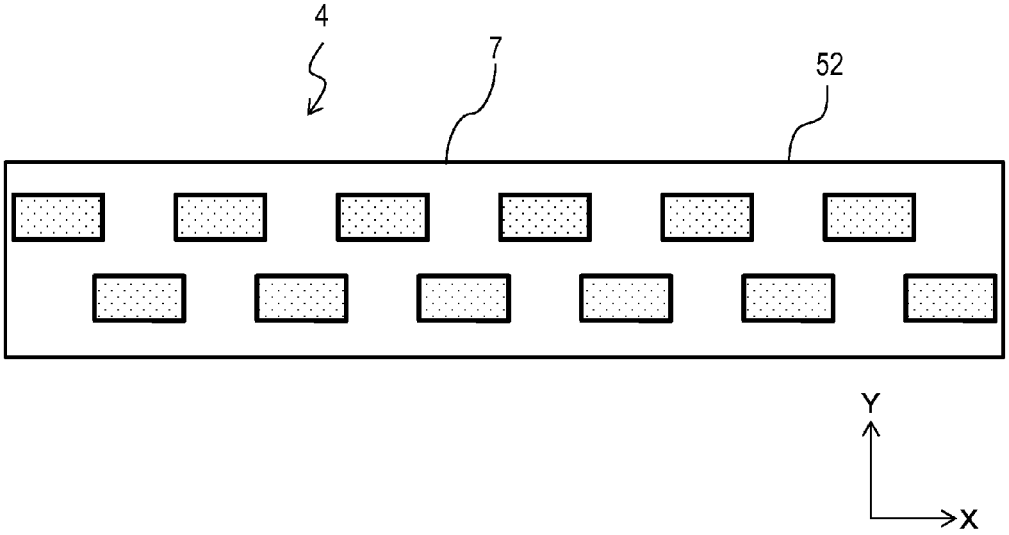
FIG. 2 is a schematic plan view of a head unit of the liquid discharge apparatus illustrated in FIG. 1.

A schematic plan view of the head unit 4 as viewed from a discharge port surface side is illustrated in FIG. 2. The head unit 4 includes a plurality of the liquid discharge heads 7, and the liquid discharge heads 7 are alternately arranged. The head unit 4 discharges a liquid over the entire width of a recording width orthogonal to a conveying direction of the recording object, by means of a plurality of liquid discharge heads 7, and records an image. The head unit 4 of the present embodiment is a so-called line head that is immovably fixed to the liquid discharge apparatus 51, and does not need to scan the recording object in the direction orthogonal to the conveying direction of the recording object. However, the present invention is also able to be applied to a liquid discharge head that scans the recording object in the direction orthogonal to the conveying direction of the recording object. The plurality of liquid discharge heads 7 are fixed to a common substrate 52 and constitute one head unit 4.

Figure 3:
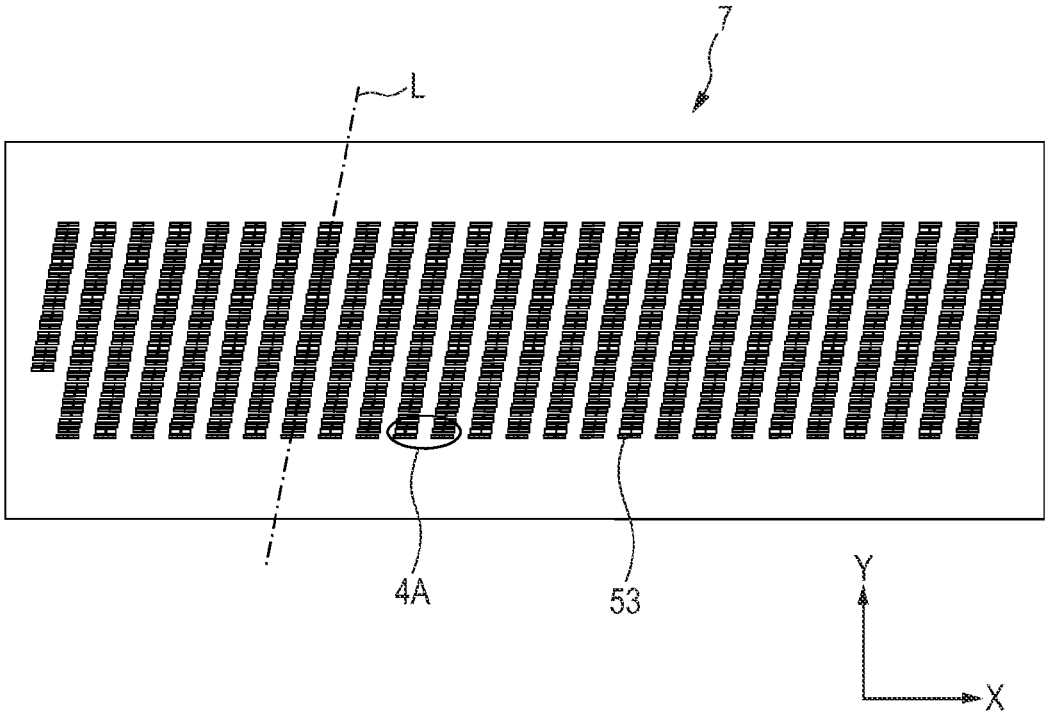
FIG. 3 is a schematic plan view of each liquid discharge head that constitutes the head unit illustrated in FIG. 2.
Figure 4A:
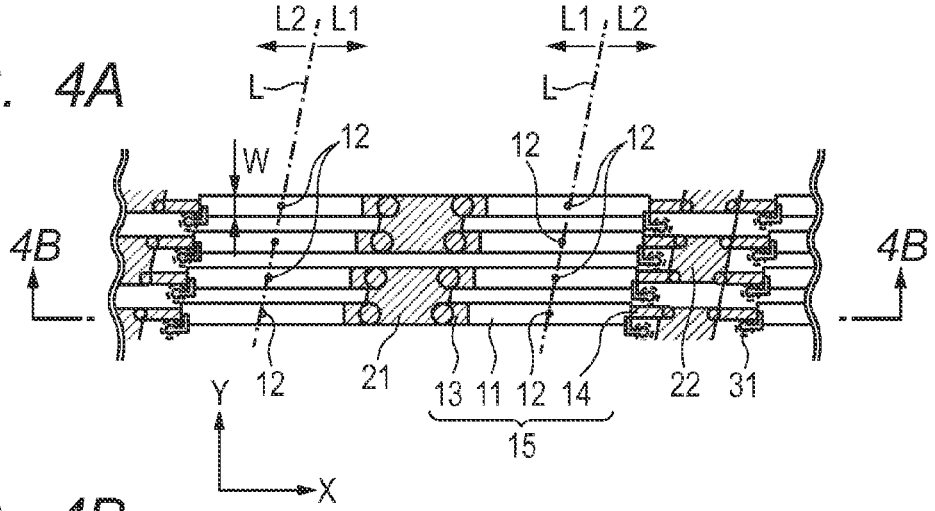
FIGS. 4A, 4B and 4C are schematic views illustrating main portions of the liquid discharge head illustrated in FIG. 3.
Figure 4B:
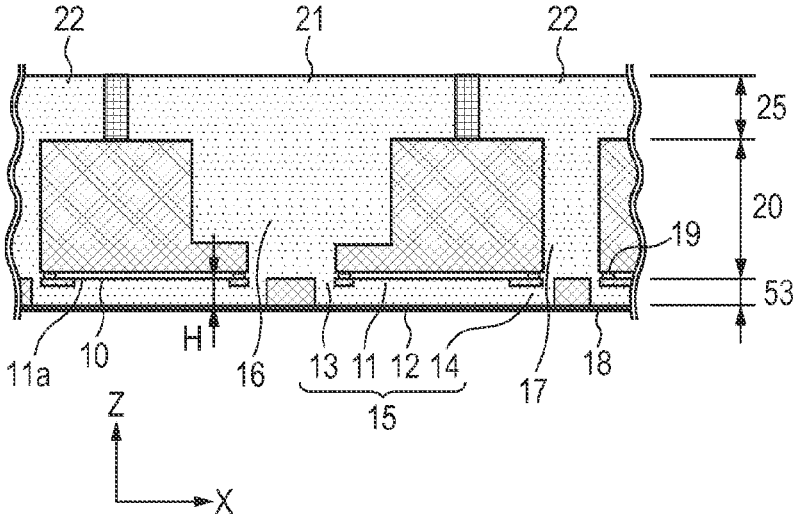
Figure 4C:
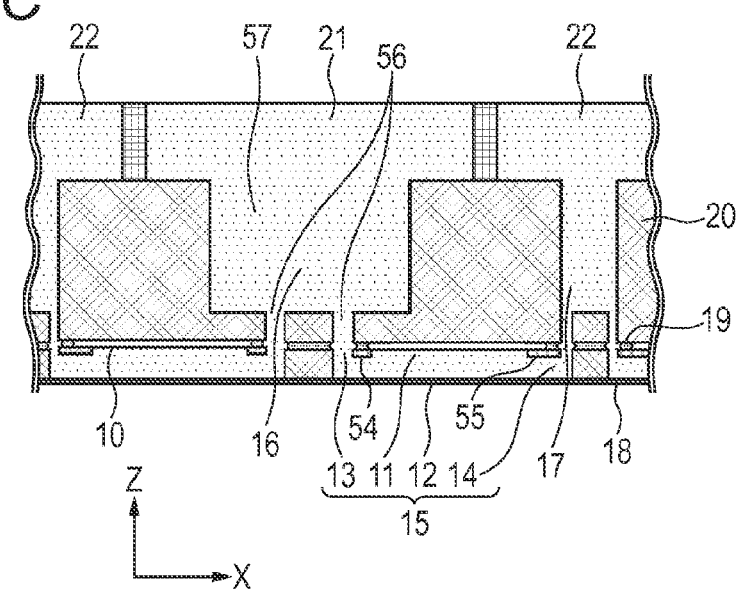

Arrangement of pressure chambers and discharge ports as viewed from the discharge port surface side of the liquid discharge head 7 is illustrated in FIG. 3. Illustration of the other members is omitted. The configuration of main portions of a liquid discharge head 7 is illustrated in FIGS. 4A to 4C. FIG. 4A is a detailed view of portion 4A of FIG. 3, and illustrates the arrangement of main portions viewed from the discharge port surface side. FIG. 4B illustrates a sectional view of the liquid discharge head 7 cut at line 4B-4B of FIG. 4A.

The liquid discharge head 7 has a plurality of liquid discharge portions 15 that are arranged in two dimensions. Each liquid discharge portion 15 has a pressure chamber 11 including a discharge port 12 through which a liquid is discharged, and a bending-type piezoelectric element 10 that faces the discharge port 12. The liquid discharge head 7 of the present embodiment includes about 1000 discharge ports 12, and is able to perform the recording at 1200 dpi. A plurality of the discharge ports 12 form a discharge port array L. The discharge port array L extends in a first direction. In the present embodiment, a plurality of the discharge port arrays L are provided. The liquid discharge head 7 has a common liquid supply flow path 21 that extends in parallel with and adjacent to the discharge port array L on one side L1 of the discharge port array L, and a common liquid collection flow path 22 that extends in parallel with and adjacent to the discharge port array L on the other side L2 of the discharge port array L. The pressure chamber 11 extends in a direction (second direction) intersecting the array direction of the discharge ports 12, and includes an inlet end portion 13 connected to the common liquid supply flow path 21, and an outlet end portion 14 connected to the common liquid collection flow path 22. A plurality of the inlet end portions 13 are arranged along the common liquid supply flow path 21, and a plurality of the outlet end portions 14 are arranged along the common liquid collection flow path 22. One common liquid supply flow path 21 or one common liquid collection flow path 22 is provided between the discharge port arrays L adjacent to each other. The common liquid supply flow path 21 and the common liquid collection flow path 22 are located opposite to the discharge port 12 with respect to the piezoelectric element 10. Three or more discharge port arrays may be provided. For example, the plurality of discharge port arrays may include first, second, and third discharge port arrays in each of which the plurality of discharge ports are arranged along the first direction, and the common liquid collection flow path 22 may include a first common liquid collection flow path and a second common liquid collection flow path. In this case, the first common liquid collection flow path, the first discharge port array, the common supply liquid flow path, the second discharge port array, the second common liquid collection flow path, and the third discharge port array are provided in this order in a second direction as viewed from a direction in which a liquid is discharged from the discharge ports.

The liquid discharge portions 15 belonging to the same discharge port array L are gradually shifted from each other in a longer direction X of the pressure chamber 11 or the liquid discharge head 7. That is, the discharge port array L is not orthogonal to the longer direction X of the pressure chamber 11 or the liquid discharge head 7, and extends linearly so as to incline slightly with respect to a shorter direction Y of the pressure chamber 11 or the liquid discharge head 7. Although four rows of liquid discharge portions 15 per one discharge port array L are illustrated in FIG. 4A, for example, 40 rows of liquid discharge portions 15 are provided. As the recording object is conveyed in the shorter direction Y of the pressure chamber 11 or the liquid discharge head 7 and each liquid discharge portion 15 discharges a liquid to a position gradually shifted in the longer direction X, recording at 1200 dpi is performed.

Referring to FIG. 4B, the liquid discharge head 7 has a flow path member 25, a through-hole forming member 20, and a pressure chamber forming member 53. The through-hole forming member 20 is located between the flow path member 25 and the pressure chamber forming member 53. The flow path member 25 forms the common liquid supply flow path 21 and the common liquid collection flow path 22. The pressure chamber forming member 53 includes the piezoelectric element 10, and forms the pressure chamber 11. The through-hole forming member 20 has a liquid supply through-hole 16 that connects the common liquid supply flow path 21 and the pressure chamber 11, and a liquid collection through-hole 17 that connects the common liquid collection flow path 22 and the pressure chamber 11. The liquid supply through-hole 16 has a larger flow path cross-sectional area than the liquid collection through-hole 17. Accordingly, the flow path resistance of the pressure chamber 11 on the inlet side is able to be made small. The pressure chamber forming member 53 is supported by the through-hole forming member 20 via a spacer 19. The pressure chamber 11 is connected to the liquid supply through-hole 16 and the liquid collection through-hole 17 at right angles thereto at the inlet end portion 13 and the outlet end portion 14. A liquid flows into the pressure chamber 11 through the liquid supply through-hole 16 from the common liquid supply flow path 21. The liquid that has flowed into the pressure chamber 11 is collected in the common liquid collection flow path 22 through the liquid collection through-hole 17. Therefore, the liquid discharge head 7 of the present embodiment is able to perform a so-called through-flow in which a liquid within the pressure chamber 11 circulates.

Flow path restricting members 54 and 55 are provided in the vicinity of at least one of the inlet end portion 13 and the outlet end portion 14 of the pressure chamber 11, and are respectively provided in the vicinity of the inlet end portion 13 and the outlet end portion 14 in the present embodiment, so that the flow path cross-sectional area of the pressure chamber 11 is reduced. The cross-sectional areas in the inlet end portion 13 and the outlet end portion 14 of the pressure chamber 11 are made smaller than the cross-sectional area between the inlet end portion 13 and the outlet end portion 14 of the pressure chamber 11. By providing such a flow path restricted portion, when the piezoelectric element 10 is driven, a liquid is able to be prevented from superfluously flowing into the liquid supply through-hole 16 and the liquid collection through-hole 17, and a sufficient amount of the liquid is able to be held within the pressure chamber 11.

The through-hole forming member 20 completely pierces in a thickness direction Z between the liquid discharge portions 15 adjacent to each other, and partially pierces in the thickness direction Z therearound. For this reason, the liquid supply through-hole 16 has a larger flow path cross-sectional area than the inlet end portion 13 of the pressure chamber 11, and has a larger flow path cross-sectional area on the common liquid supply flow path 21 side than on the inlet end portion 13 side of the pressure chamber 11. Similarly, the liquid collection through-hole 17 has a larger flow path cross-sectional area than the outlet end portion 14. As illustrated in FIG. 4C, the liquid supply through-hole 16 may have an individual through-hole 56 that communicates with each pressure chamber 11, and a common through-hole 57 that communicates with the individual through-hole 56 and the common liquid supply flow path 21. Although illustration is omitted, the through-hole forming member 20 may have only the individual through-hole 56 that connects each pressure chamber 11 and the common liquid supply flow path 21.

The pressure chamber 11 has an elongated shape that connects the inlet end portion 13 and the outlet end portion 14. The longer direction X of the pressure chamber 11 coincides with the longer direction X of the head unit 4, that is, the direction orthogonal to the conveying direction Y of the recording object, and the shorter direction Y coincides with the shorter direction Y of the head unit 4, that is, the conveying direction Y of the recording object. The discharge port 12 is located at the center of the pressure chamber 11 in the longer direction X. The pressure chamber 11 has a rectangular flow path cross-section, and has a constant width W in the shorter direction Y of the pressure chamber 11 in a region where the pressure chamber 11 faces the piezoelectric element 10. More preferably, the piezoelectric element 10 has the constant width W and a constant height H between the inlet end portion 13 and the outlet end portion 14.

The piezoelectric element 10 has a piezoelectric film (not illustrated) and a vibration plate (not illustrated) joined to the piezoelectric film. The vibration plate forms a wall surface 11*a* that faces the discharge port 12 of the pressure chamber 11. The piezoelectric element 10 covers the whole or part of the pressure chamber 11, and has an oblong shape that is elongated in the longer direction X of the pressure chamber 11. Electrodes (not illustrated) are formed on both surfaces of the piezoelectric film. One electrode is a common electrode common to a plurality of the piezoelectric films adjacent to each other in the longer direction X, and the other electrode is an individual electrode connected to each piezoelectric film. The individual electrode is connected to a bump connecting terminal 32 (refer to FIGS. 6A and 6B) that is provided at the through-hole forming member 20 via a bump 31. The piezoelectric film and the vibration plate are deformed in an outer surface direction by a driving signal supplied to the common electrode and the individual electrode from the driving unit 5, and the volume of the pressure chamber 11 increases and decreases. Accordingly, a portion of the liquid within the pressure chamber 11 is discharged from the discharge port 12.

Figure 5:
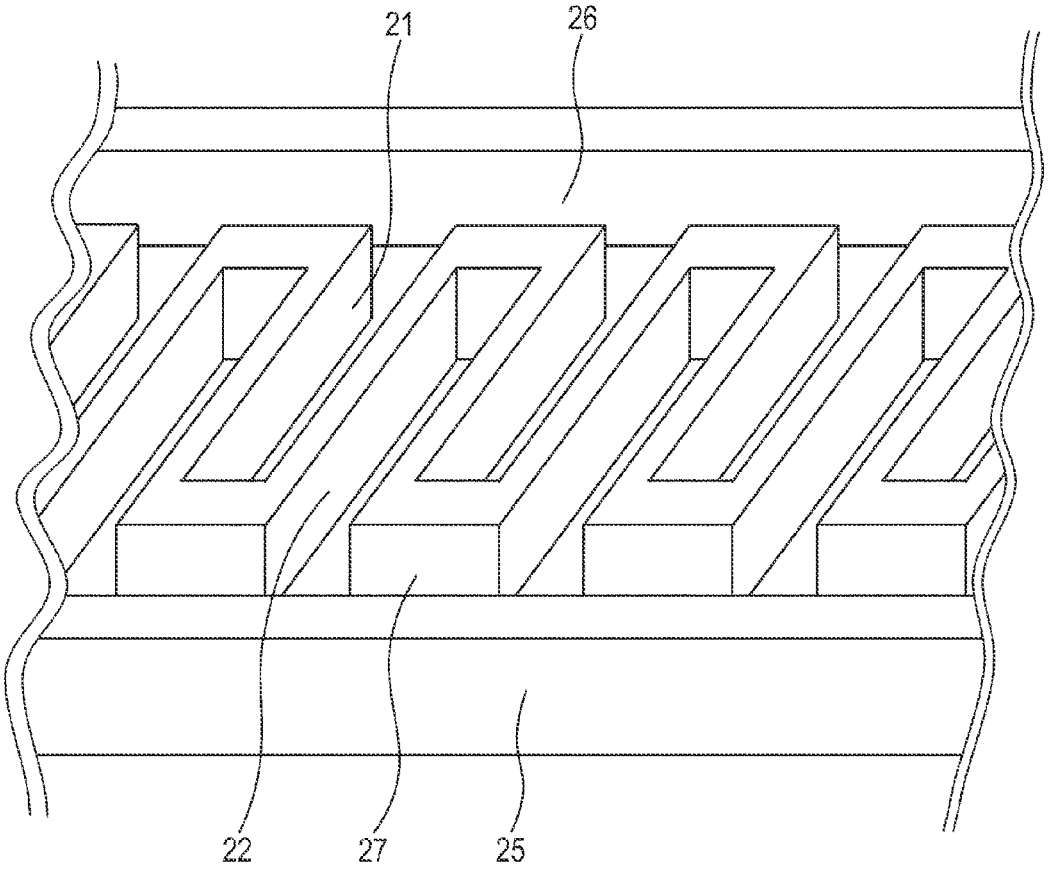
FIG. 5 is a schematic configuration diagram of a flow path member of the liquid discharge head illustrated in FIG. 3.

A perspective view of the flow path member 25 is illustrated in FIG. 5. A plurality of the common liquid supply flow paths 21 and a plurality of the common liquid collection flow paths 22 are alternately arranged in the shape of comb teeth, and the respective positions thereof corresponds to the liquid supply through-holes 16 and the liquid collection through-holes 17 that are linearly arranged. The plurality of common liquid supply flow paths 21 are connected to an inflow liquid storage portion 26, and a liquid is supplied from a liquid supply circulation device (not illustrated) of the liquid discharge apparatus 51 to the inflow liquid storage portion 26. The plurality of common liquid collection flow paths 22 are connected to the outflow liquid storage portion 27, and the liquid in the outflow liquid storage portion 27 is collected in the liquid supply circulation device of the liquid discharge apparatus 51. The collected liquid is supplied to the inflow liquid storage portion 26 by the liquid supply circulation device, whereby a circulatory flow is formed.

Figure 6A:
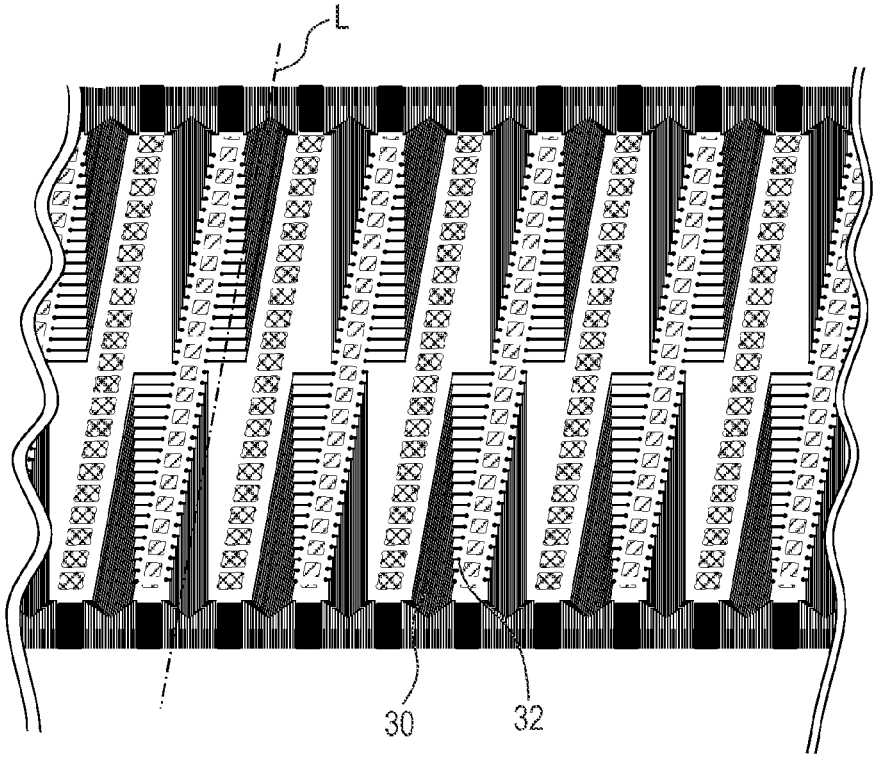
FIGS. 6A and 6B are schematic configuration diagrams of a wiring pattern of the liquid discharge head illustrated in FIG. 3.
Figure 6B:
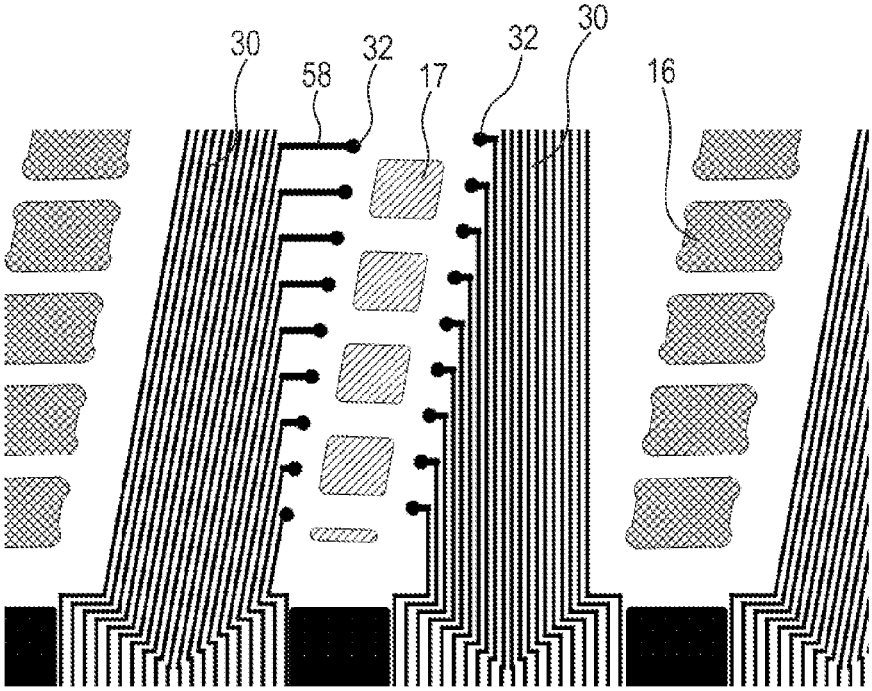

A portion of a wiring pattern 30 provided on the surface of the through-hole forming member 20 that faces the pressure chamber 11 is illustrated in FIG. 6A. FIG. 6B is a partially enlarged view of FIG. 6A. Individual wiring 58 that drives each piezoelectric element 10 extends along the discharge port array L so as to face the pressure chamber 11. As described, the individual electrode of the bending-type piezoelectric element 10 is connected to the bump connecting terminal 32 of the wiring pattern 30 provided on the through-hole forming member 20 via the bump as illustrated in FIG. 4A. The wiring pattern 30 is connected to a flexible cable (not illustrated) at an end portion of the through-hole forming member 20. The wiring pattern 30 extends between the row of liquid supply through-holes 16 and the row of liquid collection through-holes 17 in substantially the same direction as that of these rows. In the present embodiment, the wiring pattern 30 of an upper half in FIG. 6A of the discharge port array L is led out to an upper side, and the wiring pattern 30 on a lower half is led out to a lower side. However, all the wiring patterns 30 may be led out on one side.

Next, the effects of the present embodiment will be collectively described.

First, the through-flow is realized by the liquid discharge head 7 of the present embodiment. For this reason, a discharge failure caused as a result of an increase in the viscosity of a liquid in the vicinity of the discharge port 12 during non-discharge of the liquid is able to be prevented. Even when air bubbles are generated within the pressure chamber 11 due to continuous discharge or the like, the air bubbles are able to be removed together with the liquid to prevent a discharge failure.

In the liquid discharge head 7 of the present embodiment, the pressure chamber 11 has an elongated shape. Therefore, it is easy to secure the intervals (intervals in the longer direction X) of the common liquid supply flow paths 21 and the common liquid collection flow paths 22. Therefore, the flow path widths of the common liquid supply flow path 21 and the common liquid collection flow path 22 are able to be increased. Moreover, since the pressure chamber 11 has the elongated shape in which the width thereof in the shorter direction Y is small, a plurality of the pressure chambers 11 are able to be arranged in high density in the shorter direction Y. Therefore, the lengths of the common liquid supply flow path 21 and the common liquid collection flow path 22 of the pressure chamber 11 are able to be shortened. For these reasons, pressure gradients along the common liquid supply flow path 21 and the common liquid collection flow path 22 are able to be made small while securing a sufficient flow rate to each liquid discharge portion 15. Therefore, a sufficient flow rate of liquid for high-speed recording and the through-flow is able to be supplied to each liquid discharge portion 15 while equalizing the negative pressure in each discharge port 12.

Since the discharge port array L inclines slightly obliquely with respect to the shorter direction Y of the pressure chamber 11, the discharge ports 12 are able to be arranged in high density in the longer direction X of the discharge port array L irrespective of whether the intervals of the discharge ports 12 adjacent to each other in the longer direction X are wide. Additionally, since the common liquid supply flow path 21 and the common liquid collection flow path 22 extend substantially in the shorter direction Y of the pressure chamber 11, the lengths of the common liquid supply flow path 21 and the common liquid collection flow path 22 do not become long even if the dimension of the liquid discharge head 7 in the longer direction X is increased so as to increase printing width in the longer direction X.

In order to prevent an increase in the viscosity of the liquid, a certain degree of flow velocity is required, and it is desirable to enhance the flow velocity particularly at the position of the discharge port 12. In the liquid discharge head 7 of the present embodiment, since the pressure chamber 11 is elongated and has a flow path cross section that is substantially uniform in the flow path direction, a substantially uniform flow velocity is obtained over the entire length of the pressure chamber 11 including the vicinity of the discharge port 12. Since there is also no place where the flow velocity remarkably decreases within the pressure chamber 11, an irregular flow is not easily generated. For this reason, even when minute air bubbles are generated, the air bubbles are smoothly discharged without stagnating within the pressure chamber 11. Particularly, in the present embodiment, the height of the pressure chamber 11 is determined depending on the thickness of the pressure chamber forming member 53. Therefore, it is easy to optimize the height of the pressure chamber 11 such that a required flow velocity and a required flow rate are obtained. In this way, in the liquid discharge head 7 of the present embodiment, a uniform and large flow velocity is able to be obtained at a small flow rate, and the effect of the through-flow is able to be sufficiently obtained. As a result of suppressing the flow rate of the pressure chamber 11, the flow rates of the common liquid supply flow path 21 and the common liquid collection flow path 22 are able to be prevented from increasing, and the pressure gradients resulting from a flow path resistance are able to be further lowered.

The liquid discharge head 7 of the present embodiment has the elongated bending-type piezoelectric element 10 conforming to the shape of the elongated pressure chamber 11. Since the width (dimension in the shorter direction Y) is narrow, high rigidity is able to be obtained even if the piezoelectric film and the vibration plate that constitute the piezoelectric element 10 are made thin. Additionally, by optimizing the length in the longer direction X, it is possible to secure a required amount of displacement. The bending-type piezoelectric element 10 generally has high rigidity if the vibration plate and the piezoelectric film that constitute the piezoelectric element are made thick, and has a large amount of displacement if the vibration plate and the piezoelectric film are made thin. The rigidity is inversely proportional to the cube of the thickness, and the displacement with respect to the same driving voltage is inversely proportional to the square of the thickness. Additionally, if the space of an outer peripheral portion that supports the bending-type piezoelectric element 10 is narrow, the rigidity is high, and if the space is wide, the displacement is large. The rigidity with respect to pressure is inversely proportional to the fifth power of the width, and the width has a great influence on the rigidity. Volume displacement is proportional to the cube of the width. In the elongated oblong bending-type piezoelectric element 10, the length thereof in the longer direction X has only a primary influence on rigidity. Since the width is substantially constant over the entire region of the pressure chamber 11, the displacement and the rigidity are able to be optimized over the entire region of the pressure chamber 11 by optimizing the thicknesses and the widths of the vibration plate and the piezoelectric film. Moreover, a displacement volume required for discharge is able to be obtained by appropriately designing the length in the longer direction X.

Incidentally, the circular bending-type piezoelectric element 10 described in Japanese Patent Application Laid-Open No. 2012-532772 is disadvantageous when being driven at high speed. Although the circular bending-type piezoelectric element 10 is excellent in terms of securing the displacement, the rigidity thereof is low. Since the resonant frequency of the discharge port 12 is proportional to the ½ power of the rigidity and the −½ power of inertance, the resonant frequency becomes low. In order to increase the rigidity, it is necessary to thicken the piezoelectric film and the vibration plate that constitute the piezoelectric element 10. However, it becomes difficult to secure a required amount of displacement in that case.

Since the pressure chamber 11 is elongated as described above, securing an installation space in the wiring pattern 30 provided in the vicinity of the pressure chamber 11 is easy. That is, since the spacing between the row of the liquid supply through-holes 16 and the row of the liquid collection through-holes 17 is wide, a plurality of strands of individual wiring 58 are able to be arranged in parallel in the substantially same direction as the common liquid supply flow paths 21 and the common liquid collection flow paths 22. In this case, it is not necessary to make the width of the individual wiring 58 excessively small. Moreover, since the lengths of the common liquid supply flow path 21 and the common liquid collection flow path 22 are shortened as described above, the length of the wiring pattern 30 is similarly prevented from increasing. For these reasons, the resistance of the individual wiring 58 is able to be made low. In order to perform high-speed recording, a driving voltage signal includes a high frequency component. However, as a result of suppressing the resistance of the individual wiring 58, the distortion of the waveform of the driving voltage signal is also suppressed, and a driving voltage signal with little noise is able to be applied to the bending-type piezoelectric element 10.

Since the discharge port 12 is located substantially at the center of the pressure chamber 11, the distance from the discharge port 12 to an end portion of the pressure chamber 11 is small. For this reason, the inertance is small, the resonant frequency becomes high, and high-speed driving is achieved. When the discharge port 12 is provided at one end of the elongated pressure chamber 11, the distance from the other end of the pressure chamber 11 to the discharge port 12 becomes long. Since a liquid that is present from the other end of the pressure chamber 11 to the discharge port 12 needs to move toward the discharge port 12 during driving, the inertance becomes large. In the present embodiment, the distance from an end portion of the pressure chamber 11 to the discharge port 12 becomes approximately ½ of that in the above-described case.

Since the through-hole forming member 20 has the liquid supply through-hole 16, it is possible to substantially increase the height of the common liquid supply flow path 21, and it is easier to supply a sufficient flow rate of liquid for the high-speed recording and the through-flow. Moreover, in the liquid discharge head 7 of the present embodiment, two inlet end portions 13 adjacent to each other in the longer direction X are connected to one liquid supply through-hole 16, and two outlet end portions 14 adjacent to each other in the longer direction X are connected to one liquid collection through-hole 17. That is, two liquid discharge portions 15 share one liquid supply through-hole 16 or one liquid collection through-hole 17. As a result, the arrangement intervals of the common liquid supply flow paths 21 and the common liquid collection flow paths 22 in the longer direction X of the pressure chamber 11 become twice as large as the arrangement intervals of the liquid discharge portions 15, so that the flow width of at least one of the common liquid supply flow path 21 and the common liquid collection flow path 22 is able to be further increased. Even when only the individual through-hole is provided in the through-hole forming member 20, the flow path widths of the common liquid supply flow path 21 and the common liquid collection flow path 22 are able to be increased.

In the liquid discharge head 7 of the present embodiment, the common liquid supply flow path 21 and the common liquid collection flow path 22 are located opposite to the discharge port 12 with respect to the pressure chamber 11. Since the common liquid supply flow path 21 and the common liquid collection flow path 22 are not so restricted in terms of arrangement, a sufficient flow path height is able to be secured. Therefore, it is possible to supply a sufficient flow rate of liquid for the high-speed recording and the through-flow.

Second Embodiment

Figure 7:
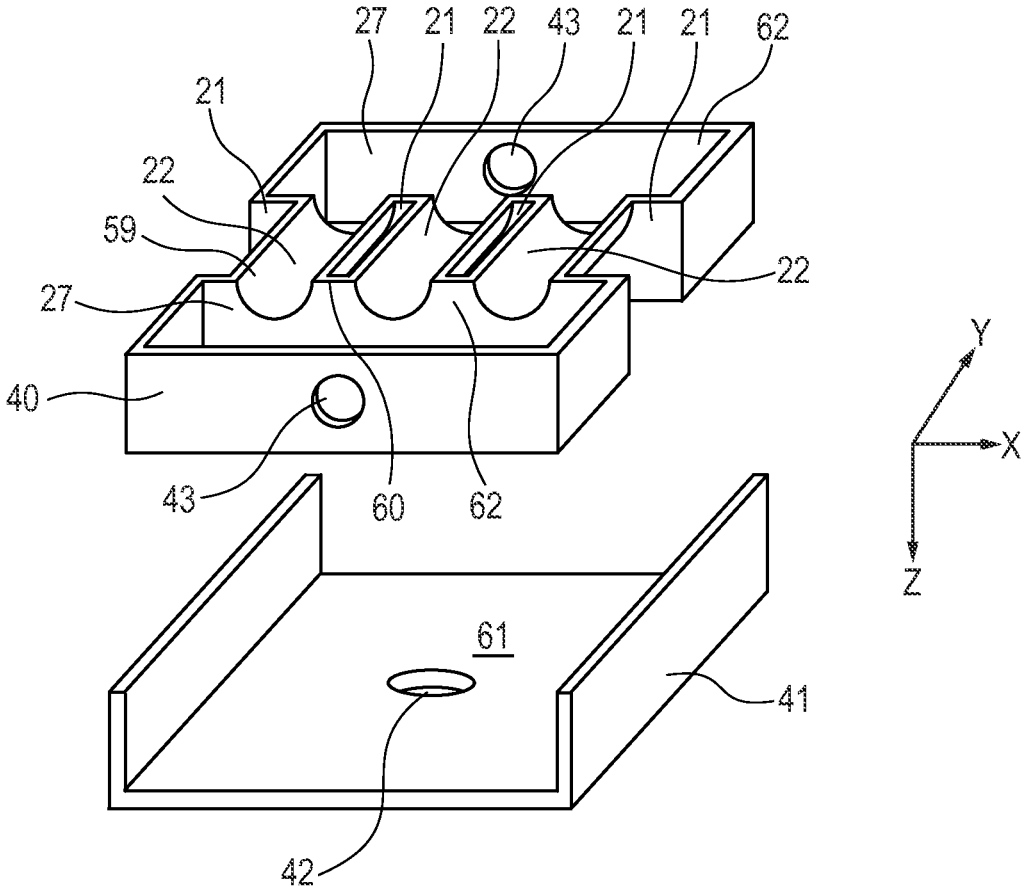
FIG. 7 is a schematic configuration diagram of the flow path member related to a second embodiment.

A schematic configuration of the flow path member of the liquid discharge head 7 related to a second embodiment is illustrated in FIG. 7. The configuration and the effects of the present invention that are not described below are the same as those of the first embodiment. FIG. 7 illustrates the liquid discharge head 7 having six rows of the discharge port arrays that are arranged so as to incline slightly with respect to the shorter direction Y of the pressure chamber 11, four rows of the liquid supply through-holes, and three rows of the liquid collection through-holes, in order to make the drawing easily understood. However, the numbers of discharge port arrays, liquid supply through-hole, and liquid collection through-holes are not limited to this. The flow path member 25 is constituted of a groove member 40 and a lid member 41. Although these are separately illustrated in the diagram, these are joined together in practice. The lid member 41 is provided with a supply tube connecting hole 42 to which a pipe (not illustrated) that supplies a liquid is connected. The groove member 40 is provided with a collection pipe connecting hole 43 to which a pipe (not illustrated) that collects a liquid is connected. A groove member 40 has groove portions 59 and ridge portions 60 that are alternately arranged. A ridge portion 60 forms the common liquid supply flow path 21 together with the through-hole forming member 20 that faces the ridge portion. The groove portion 59 is adjacent to the ridge portion 60, and forms the common liquid collection flow path 22 having the groove shape together with the through-hole forming member 20.

A liquid flows into the common liquid supply flow path 21 sandwiched between the common liquid collection flow paths 22 from a common liquid chamber 61 between the ridge portion 60 and the lid member 41, and is supplied to each liquid discharge portion 15 from the common liquid supply flow path 21. A liquid is collected in the grooved common liquid collection flow path 22 from each liquid discharge portion 15, and flows into the common liquid chamber 62. The supplied liquid flows in a perpendicular direction (upward direction in the drawing) with respect to the through-hole forming member 20. Since the common liquid supply flow path 21 has a tapered flow path in which the flow path cross-sectional area decreases as it approaches the through-hole forming member 20, pressure resistance is small. Therefore, the flow path resistance of the pressure chamber 11 on the inlet side is able to be made small.

Third Embodiment

Figure 8A:
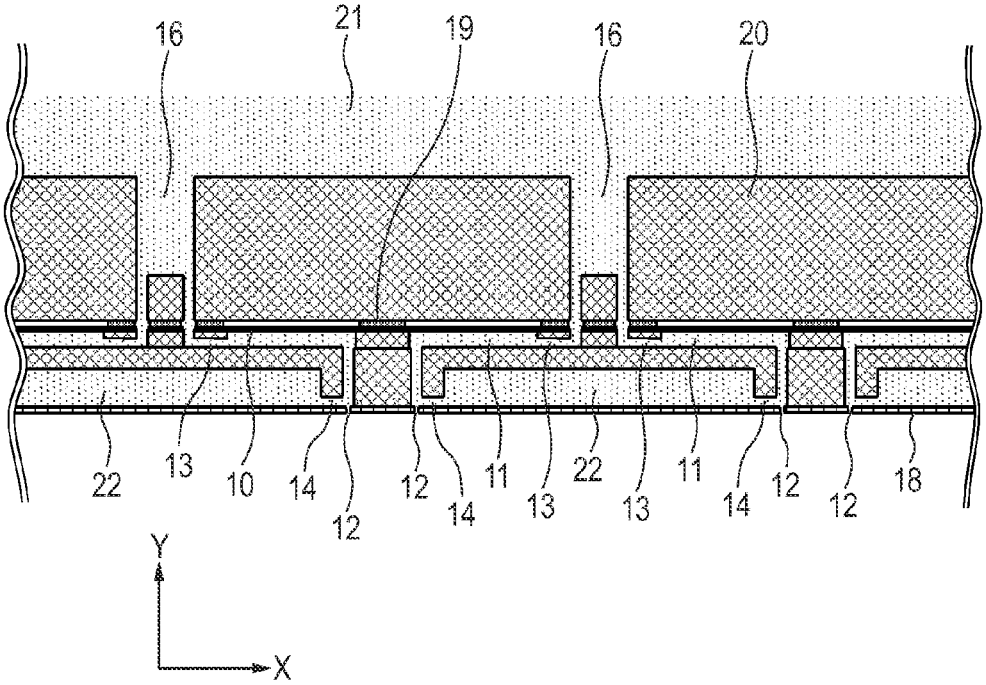
FIGS. 8A and 8B are schematic views illustrating main portions of the liquid discharge head related to a third embodiment.
Figure 8B:
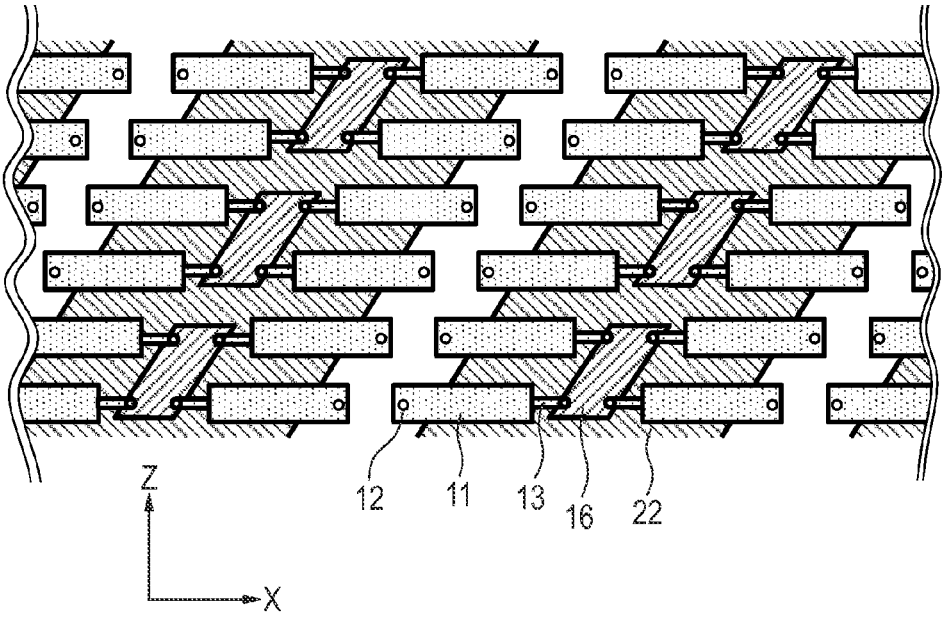

The outline of the liquid discharge head 7 related to a third embodiment is illustrated in FIGS. 8A and 8B. The configuration and the effects of the present invention that are not described below are the same as those of the first embodiment. FIG. 8A is a plan view illustrating main portions of the liquid discharge head 7, and illustrates the positional relationship between main elements. In order to intelligibly illustrate the drawing, smaller elements are illustrated so as to be illustrated more front not in the stacking order of the respective members. FIG. 8B is a sectional view of the main portions. The common liquid supply flow path 21 is located opposite to the discharge port 12 with respect to the piezoelectric element 10, and the common liquid collection flow path 22 is located on the same side as the discharge port 12 with respect to the piezoelectric element 10. The outlet end portion 14 connects the vicinity of the discharge port 12 with the common liquid collection flow path 22. The common liquid collection flow path 22 is connected to the outflow liquid storage portion (not illustrated) provided at an end portion of the discharge port array L.

The common liquid supply flow path 21 is a liquid reservoir that covers the entire back surface of the through-hole forming member 20 opposite to the discharge port 12, and a liquid is supplied to the pressure chamber 11 via the liquid supply through-hole 16 and the inlet end portion 13. The flow path resistance of the common liquid supply flow path 21 is extremely small. Although the common liquid collection flow path 22 is restricted in height, the pressure chamber 11 is elongated in the longer direction X, and is shared by two rows of the liquid discharge portions 15 adjacent to each other in the longer direction X. Therefore, it is easy to secure a dimension in the longer direction X. In the present embodiment, the discharge port 12 is located at one end of the pressure chamber 11. Therefore, the distance from the other end of the pressure chamber 11 to the discharge port 12 is long, and the inertance is large. However, the flow path resistance of the common liquid supply flow path 21 is able to be made sufficiently small as described above.

According to the present invention, the liquid discharge portions are able to be arranged in high density, and the liquid discharge head with little variation in the pressure of each liquid discharge portion is able to be provided.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-175523, filed Aug. 29, 2014, which is hereby incorporated by reference herein in its entirety.

What is claimed is:

1. A liquid discharge head comprising:

a plurality of liquid discharge portions each including a discharge port for discharging a liquid and a pressure chamber, a plurality of discharge ports forming a discharge port array;

a common liquid supply flow path extending adjacent to the discharge port array on one side of the discharge port array;

a common liquid collection flow path extending adjacent to the discharge port array on the other side of the discharge port array;

a flow path member that forms the common liquid supply flow path and the common liquid collection flow path;

a pressure chamber forming member that forms the pressure chambers; and a through-hole forming member that forms liquid supply through-holes that connect the common liquid supply flow path and the pressure chambers, and liquid collection through-holes that connect the common liquid collection flow path and the pressure chambers, wherein the flow path member, the through-hole forming member and the pressure chamber forming member are laminated in the order as listed, wherein each of the plurality of liquid discharge portions includes a piezoelectric element facing the discharge port, wherein each of the pressure chambers includes an inlet end portion connected to the common liquid supply flow path and an outlet end portion connected to the common liquid collection flow path, and has an elongated shape connecting the inlet end portion and the outlet end portion, and wherein a plurality of inlet end portions are arranged along the common liquid supply flow path, and a plurality of outlet end portions are arranged along the common liquid collection flow path.

2. The liquid discharge head according to claim 1, wherein each of the pressure chambers has a constant width in a shorter direction of the pressure chamber in a region facing the piezoelectric element.

3. The liquid discharge head according to claim 1, wherein a flow path cross-sectional area of each of the pressure chambers decreases in the vicinity of at least either one of the inlet end portion and the outlet end portion.

4. The liquid discharge head according to claim 1, wherein the discharge port array is not orthogonal to a longer direction of the pressure chambers.

5. The liquid discharge head according to claim 1, further comprising:

an individual wiring for supplying a driving signal to each of the piezoelectric elements, wherein the individual wiring faces the pressure chambers and extends along the discharge port array.

6. The liquid discharge head according to claim 5, wherein the individual wiring is provided on a surface of the through-hole forming member on the pressure chamber side.

7. The liquid discharge head according to claim 1, wherein the common liquid supply flow path and the common liquid collection flow path are located opposite to the discharge ports with respect to the piezoelectric elements.

8. The liquid discharge head according to claim 7, wherein each of the discharge ports is located at a center of the corresponding pressure chamber in the longer direction.

9. The liquid discharge head according to claim 7, wherein each of the liquid supply through-holes has a larger flow path cross-sectional area than the inlet end portion, and each of the liquid collection through-holes has a larger flow path cross-sectional area than the outlet end portion.

10. The liquid discharge head according to claim 9, wherein each of the liquid supply through-holes has a larger flow path cross-sectional area than the liquid collection through-holes.

11. The liquid discharge head according to claim 9, wherein the flow path member includes a ridge portion that forms the common liquid supply flow path together with the through-hole forming member that faces the flow path member, and a groove portion that is adjacent to the ridge portion and forms the common liquid collection flow path having a grooved shape together with the pressure chamber forming member.

12. The liquid discharge head according to claim 7, wherein the discharge port array comprises a plurality of discharge port arrays, and wherein one of the common liquid supply flow path and the common liquid collection flow path is provided between adjacent discharge port arrays.

13. The liquid discharge head according to claim 1, wherein the common liquid supply flow path is located opposite to the discharge ports with respect to the piezoelectric elements, and the common liquid collection flow path is located on the same side as the discharge ports with respect to the piezoelectric elements.

14. A liquid discharge head comprising:

a first and a second discharge port array in which a plurality of discharge ports are arranged along a first direction, the first and second discharge port arrays being arranged parallel to each other in a second direction intersecting the first direction;

pressure chambers communicating with discharge ports included in the first and second discharge port arrays and extending along the second direction;

a common liquid supply flow path formed in a substrate for supplying a liquid to a plurality of the pressure chambers, the common liquid supply flow path passing through the substrate;

a common liquid collection flow path formed in the substrate for collecting the liquid from the plurality of the pressure chambers, the common liquid supply flow path passing through the substrate;

a flow path member that forms the common liquid supply flow path and the common liquid collection flow path;

a pressure chamber forming member that forms the pressure chambers; and a through-hole forming member that forms liquid supply through-holes that connect the common liquid supply flow path and the pressure chambers, and liquid collection through-holes that connect the common liquid collection flow path and the pressure chambers, wherein the flow path member, the through-hole forming member and the pressure chamber forming member are laminated in the order as listed, and wherein the common liquid collection flow path, the first discharge port array, the common liquid supply flow path, and the second discharge port array are provided in the order as listed in the second direction as viewed from a direction in which the liquid is discharged from the discharge ports.

15. The liquid discharge head according to claim 14, wherein the common liquid supply flow path supplies the liquid to the first discharge port array and the second discharge port array.

16. The liquid discharge head according to claim 14, further comprising a third discharge port array in which a plurality of discharge ports are arranged along the first direction, wherein the common liquid collection flow path includes first and second common liquid collection flow paths, and wherein the first common liquid collection flow path, the first discharge port array, the common liquid supply flow path, the second discharge port array, the second common liquid collection flow path, and the third discharge port array are provided in the order as listed in the second direction as viewed from the direction in which the liquid is discharged from the discharge ports.

17. The liquid discharge head according to claim 16, wherein the second common liquid collection flow path collects the liquid from the second discharge port array and the third discharge port array.

18. The liquid discharge head according to claim 16, wherein the common liquid supply flow path, the first common liquid collection flow path, and the second common liquid collection flow path each extend along the first direction.

19. A liquid discharge head comprising:

a discharge port array in which discharge ports for discharging a liquid are arranged in a first direction;

pressure chambers communicating with the discharge ports and including piezoelectric elements that generate energy used to discharge the liquid at positions facing the discharge ports, the length of each of the pressure chambers in a second direction intersecting the first direction being larger than the length of the pressure chamber in the first direction;

a common liquid supply flow path extending along the discharge port array for supplying the liquid to a plurality of the pressure chambers;

a common liquid collection flow path extending along the discharge port array for collecting the liquid from the plurality of the pressure chambers;

a flow path member that forms the common liquid supply flow path and the common liquid collection flow path;

a pressure chamber forming member that forms the pressure chambers; and a through-hole forming member that forms liquid supply through-holes that connect the common liquid supply flow path and the pressure chambers, and liquid collection through-holes that connect the common liquid collection flow path and the pressure chambers, wherein the flow path member, the through-hole forming member and the pressure chamber forming member are laminated in the order as listed, and wherein each of the pressure chambers includes a supply opening communicating with the common liquid supply flow path on one end side thereof in the second direction, and includes a collection opening communicating with the common liquid collection flow path on the other end side thereof in the second direction.

* * * * *